US005119985A

United States Patent [19]

Dawson et al.

[11] Patent Number: 5,119,985

[45] Date of Patent: Jun. 9, 1992

[54] REINFORCED CARTON HANDLE

[75] Inventors: Raymond L. Dawson, Monroe; Kent E. Ewing, West Monroe, both of La.

[73] Assignee: Riverwood Natural Resources Corporation, Denver, Colo.

[21] Appl. No.: 777,843

[22] Filed: Oct. 16, 1991

[51] Int. Cl.[5] ..... B65D 5/46

[52] U.S. Cl. ..... 229/117.13; 229/117.12; 229/DIG. 4

[58] Field of Search ..... 229/117.13, DIG. 4, 229/40, 117.12; 206/427

[56] References Cited

U.S. PATENT DOCUMENTS

| | | | |
|---|---|---|---|
| 2,797,856 | 7/1957 | Jaeschke | 229/117.13 |
| 3,933,303 | 1/1976 | Kirby, Jr. | 229/117.13 |
| 3,994,432 | 11/1976 | Kirby, Jr. | 206/427 |
| 4,331,289 | 5/1982 | Killy | 206/427 |
| 4,478,334 | 10/1984 | Graser | 206/427 |
| 4,508,258 | 4/1985 | Graser | 229/117.13 |
| 4,538,759 | 9/1985 | Dutcher | 206/427 |
| 4,546,914 | 10/1985 | Roccaforte | 229/117.13 |

FOREIGN PATENT DOCUMENTS

| | | | |
|---|---|---|---|
| 877792 | 8/1971 | Canada | 229/117.13 |

*Primary Examiner*—Gary E. Elkins
*Attorney, Agent, or Firm*—Cornelius P. Quinn

[57] ABSTRACT

An enclosed carrier having spaced handle openings in the top panel. The top panel is formed from two overlapping flaps, each of which has a folded-over edge portion adhered to itself. The folded-over edge portions overlie each other to form the strap portion of the handle extending between the handle openings, with the folds of the edge portions being aligned with the inner edges of the handle openings. In one embodiment the handle strap comprises a four-ply layer and in another embodiment it comprises a three-ply layer. The folded-over edge portions of the top flaps may be weakened at their intersection with the fold lines of end panel flaps to enable the end panel flaps to be readily folded into place.

11 Claims, 3 Drawing Sheets

REINFORCED CARTON HANDLE

FIELD OF THE INVENTION

This invention relates to an integral handle structure of a carton. More particularly, it relates to a reinforced handle in a carton suitable for carrying beverage containers.

BACKGROUND OF THE INVENTION

Beverage cans are commonly packaged in an enclosed carton formed from a single blank, wherein the top panel of the carton contains an integrally formed handle. A great many different handle designs have been developed which enable carriers to be lifted by one hand without causing the handle or other vulnerable parts of the carrier to tear as a result of the forces applied during lifting and carrying. Many of the handles developed are suitable for cartons that carry relatively light loads, such as six or even twelve beverage cans, but are not capable of use when the load is greater, such as in a carton designed to carry twenty-four beverage cans.

Adjacent rows of cans are typically packaged in such larger size carriers so that they extend transversely of the carrier from one side panel to the other. The top panel of the carrier is typically provided with transversely spaced handle openings in a so-called suitcase type handle design, which enables a user to lift the carton by the handle strap between the openings. Such an arrangement is desirable because it permits the use of a simple blank design whereby end panel sections of the blank are overlapped to form the top panel of the carrier and the end panels of the carrier are formed from flaps extending from the top, side and bottom panels. Because the handle strap formed from the overlapped portions of the blank is comprised of only a double layer of material, this vital area of the carton has often been found to be inadequate when the carton contains heavy loads, and efforts have been made to reinforce it.

For example, in U.S. Pat. No. 3,933,303 an extra section provided at one end of the blank is folded under the top panel to provide either three or four plies of material in the handle strap. A different arrangement is disclosed in U.S. Pat. No. 4,331,289 which also suggests providing additional material at the end of the blank to enable it to be folded under to form a four-ply handle strap. In both cases the extra material is provided as an extension of one of the top panel sections and is not connected to an end panel flap. This allows the extension to be folded under without interfering with the folding of the end panel flaps, but does not result in optimum reinforcement of the carton.

Known reinforced suitcase-type handles can function satisfactorily under normal conditions. But when subjected to higher than normal stresses the handle strap tends to rip across the hand holes.

It would be desirable to be able to modify the blank used to form this basic type of carton in a simple, economical manner so as to result in a reinforced handle capable of supporting a heavy load.

SUMMARY OF THE INVENTION

The carrier of the invention is of conventional overall design, made up of two side panels, each having a top edge connected to a top panel, a bottom edge connected to a bottom panel and end edges connected to opposite end panels, with the top panel being formed of an outer top panel flap foldably connected to one of the side panels along the top edge thereof and an inner top panel flap foldably connected to the other side panel along the top edge thereof. The outer top panel flap overlaps the inner top panel flap and is adhered to it in the overlapped area. Each top panel flap contains a handle opening on opposite sides of the overlapped area.

The overlapping portion of the outer top panel flap is folded over upon itself to form a layer of double thickness adjacent the handle opening in the inner top panel, and the overlapped portion of the inner top panel flap is folded over upon itself to form a layer of double thickness adjacent the handle opening in the outer top panel, whereby the overlapped portions of the top panel flaps form folds adjacent the inner edges of the handle openings. This arrangement can provide for either a three-ply or four-ply layer between the handle openings.

In a preferred arrangement the handle opening in the outer top panel flap has an inner edge substantially aligned with the fold of the folded-over portion of the inner top panel flap and the handle opening in the inner top panel flap has an inner edge substantially aligned with the fold of the folded-over portion of the outer top panel flap. Further, in the preferred arrangement the inner edges of the handle openings extend substantially parallel to the top edges of the side panels.

In another aspect of the invention, each end panel is comprised of flaps which are foldably connected to the top, bottom and side panels, and the end panel flaps connected to the top panel comprise extensions of the inner and outer top panel flaps, including three- or four-ply portions as in the top panel. The fold lines about which the end portions of the top panel flaps are folded upon themselves intersect the fold lines which connect the upper end panel flaps to the top panel, and they are weakened at the intersection to enable the upper end panel flaps to be folded into place.

The invention requires little modification to conventional carton blank designs, yet results in a very strong handle capable of lifting heavy loads. Further, as pointed out in more detail below, if the carrier fails under excessive forces the mode of failure is such that the carrier and its contents remain intact.

The features of the invention that provide the desired results are brought out in more detail in the description of the preferred embodiments wherein the above and other aspects of the invention, as well as other benefits, will readily be apparent.

DETAILED DESCRIPTION OF THE PREFERRED EMBODIMENTS

Figure 1:
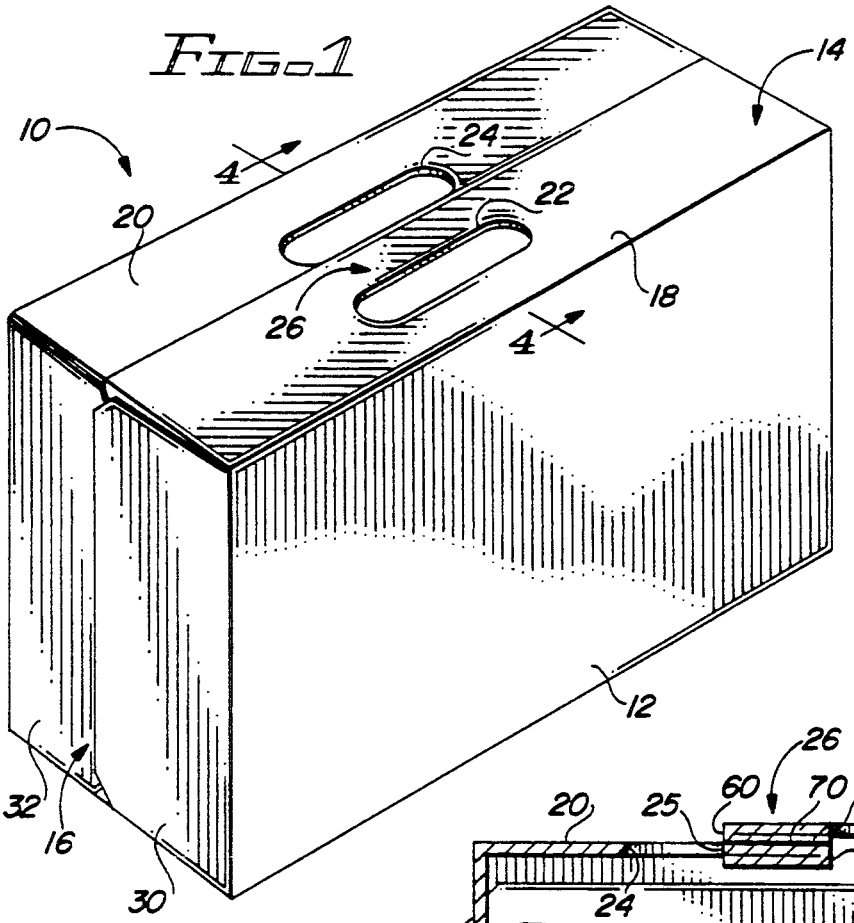
FIG. 1 is a pictorial view of a carrier which incorporates the handle of the present invention.

Referring to FIG. 1, a carrier 10 is illustrated which is comprised of side panels 12 foldably connected to top panel 14, end panels 16 and a bottom panel, not visible. The top panel 14 is formed from two overlapping flaps 18 and 20 which are foldably connected to opposite side panels 12. Handle openings 22 and 24 are provided in the flaps 18 and 20, respectively, through which a user's hand can be inserted in order to grasp the strap portion 26 between the handle openings to lift and carry the carton. The end panels 16 are formed from overlapping end flaps 30 and 32 which are foldably connected to the opposite side panels and which contact end flaps foldably connected to the top and bottom panels. The carrier described thus far is conventional in design, capable of holding a number of adjacent rows of transversely extending articles such as beverage cans. As described more fully below, however, the handle strap portion 26 of this preferred embodiment is formed of three or four plies of material arranged in a unique manner which provides greater reinforcement than previous handle designs.

Figure 2:
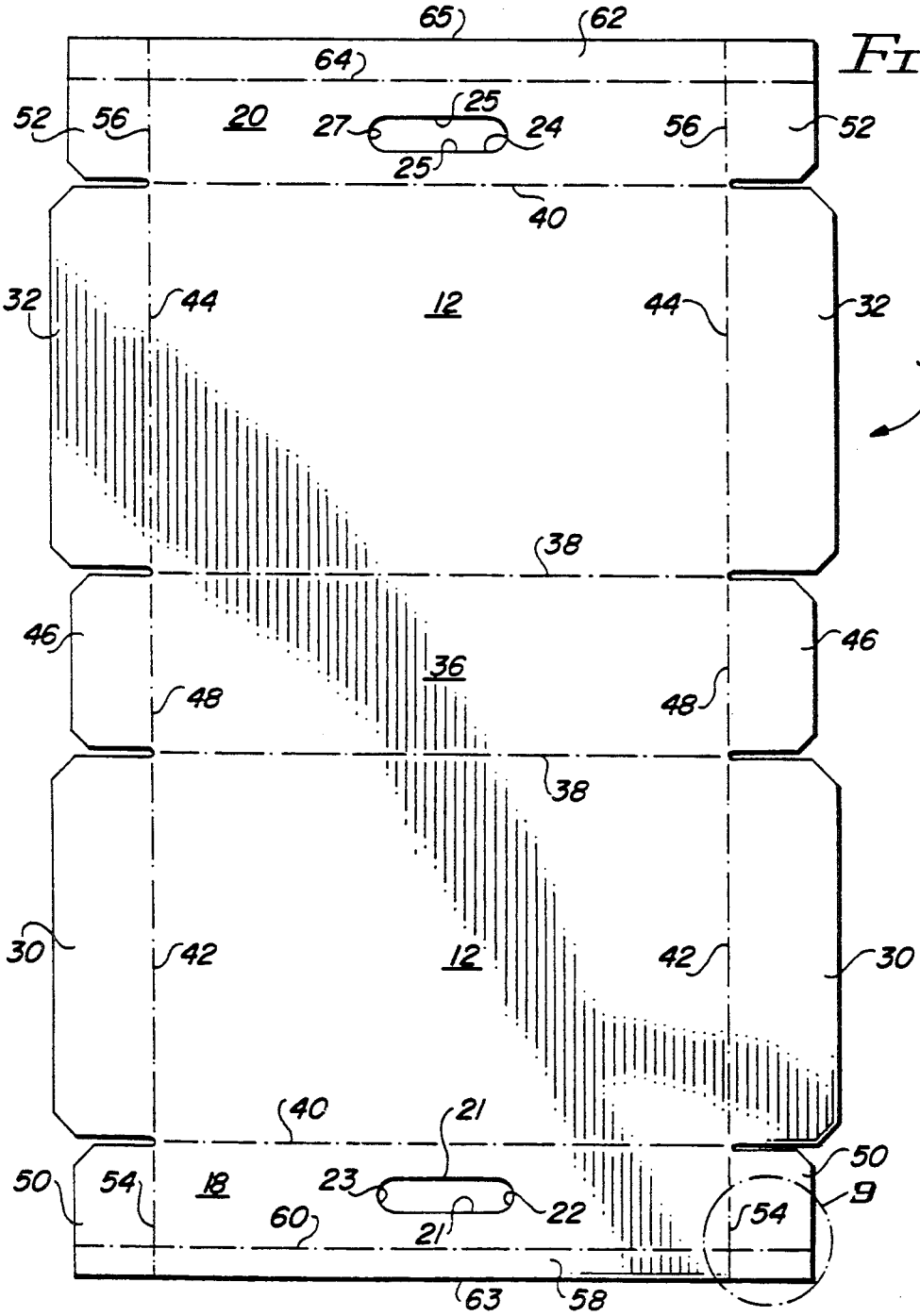
FIG. 2 is a plan view of a blank for forming the carrier of FIG. 1.

The blank for forming the carrier is illustrated in FIG. 2, wherein a generally rectangular blank 34 of suitable material, such as paperboard, is comprised of various sections that correspond to the panels and flaps of the carrier of FIG. 1. Thus, intermediate sections 12, corresponding to side panels 12, are connected to a central bottom panel section 36 along fold lines 38 and to the top panel flaps 18 and 20 along fold lines 40. The end panel flaps 30 and 32 are connected to their respective side panel sections 12 along fold lines 42 and 44, lower end panel flaps 46 are connected to bottom panel section 36 along fold lines 48, and upper end panel flaps 50 and 52 are connected to top panel flaps 18 and 20 along their respective fold lines 54 and 56. The handle openings 22 and 24 are identical, each being comprised of elongated spaced edges connected by arcuate end edges to form an elongated oval shape the elongated edges of which lie substantially parallel to the end edges of the blank. Thus, the opening 22 has spaced elongated edges 21 connected to arcuate edges 23, while opening 24 has spaced elongated edges 25 connected to arcuate edges 27.

In addition to the structure described thus far, each top panel flap 18 and 20 includes an extension or reinforcement flap. Thus, a relatively narrow reinforcement flap 58 is connected to top panel flap 18 along fold line 60 and a relatively narrow reinforcement flap 62 is connected to the other top panel flap 20 along fold line 64. The fold lines 60 and 64 are parallel to and, as measured in a direction perpendicular to the fold line 60, equally spaced from the associated end edges of the blank and the nearest elongated edge of the elongated handle opening. The distance from fold line 60 to the blank end edge 63 is therefore the same as the distance from fold line 60 to the handle opening edge 21. The fold line 64 is similarly arranged with respect to blank edge 65 and handle opening edge 25. The fold lines 60 and 64 extend into the end panel flaps 50 and 52, and the fold lines 54 and 56, which are extensions of the fold lines 42, 44 and 48, extend into the reinforcement flaps 58 and 62, thereby intersecting the fold lines 60 and 64.

A carrier is formed from the blank of FIG. 2 in the usual manner. The blank is folded about one of the fold lines 38 and the top panel flaps 18 and 20 are glued together to form a collapsed sleeve. The blanks are normally fed in collapsed sleeve form to a packaging machine where they are opened, the articles to be packaged are inserted into the sleeve through the open ends, and the end panels of the carrier are formed by folding the end panel flaps and gluing them together. The end panels are conventionally formed by first folding the top and bottom end panel flaps and then folding and adhering the end panel flaps 30 and 32 to the underlying top and bottom end panel flaps and to each other. As is conventional, the combined flaps 50 and 52, which become adhered to each other when the top panel flaps 18 and 20 are glued together, form the upper end panel flap.

Figure 3:
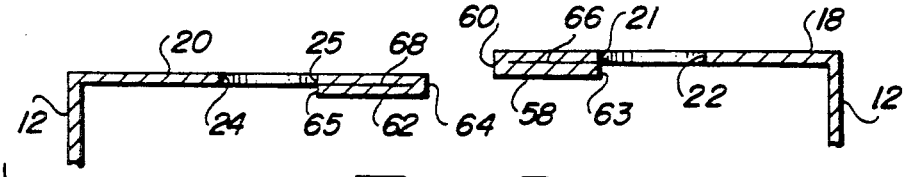
FIG. 3 is an enlarged partial transverse sectional view of the top panel flaps prior to being moved into final top panel forming position.

Normally, the top panel flaps of a carton blank of this general type of carrier are connected by glue applied to the overlapping area of the flaps, which results in an area of double thickness in the strap portion between the handle openings. In the present invention, however, the reinforcement flaps 58 and 62 are first folded about their fold lines 60 and 64 so that they are in face-to-face contact with the underside of the adjacent top panel flap. This arrangement is shown in FIG. 3, which illustrates the top panel flaps 18 and 20 just prior to being moved into their final overlapping relationship. Because of the dimensional relationship described above, the edges 21 and 63 are aligned, as are the edges 25 and 65. The reinforcement flaps 58 and 62 are held in their folded position by a layer of suitable adhesive 66 and 68 which will have been applied to either or both of the reinforcement flaps and their adjacent top panel flap.

Figure 4:
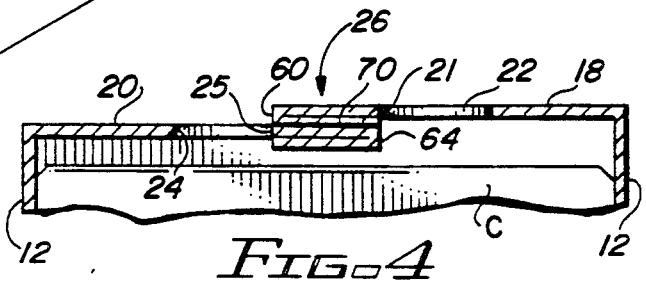
FIG. 4 is an enlarged partial transverse sectional view of the carton handle area taken on line 4—4 of FIG. 1.

As illustrated in FIG. 4, which shows a beverage can C immediately beneath the top panel of the carrier, the top panel flaps 18 and 20 of FIG. 3 have been overlapped so that the folded reinforcement flap 58 overlies the portion of the top panel flap 20 that overlies the folded reinforcement flap 62. These overlapped portions are adhered together by a layer of adhesive 70. The resulting strap portion 26 between the handle openings 22 and 24 is comprised of four plies of material, with the fold of each reinforcement flap being aligned with the inner edge of its associated handle opening. Thus, the edge comprised of the fold or score 60 is aligned with the underlying inner edge 25 of the opening 24, while the edge comprised of the fold or score 64 is aligned with the overlying inner edge 21 of the opening 22. Both longitudinal edges of the handle strap between the two handle openings are thereby comprised in part by a folded edge portion.

The provision of a folded edge portion at each side of the handle strap is important to the tear resistance of the handle. This was proved by tests run on a carton testing machine comparing conventional style 24-can packages with similar packages made in accordance with the present invention. The top panel of the conventional carton was formed from overlapping top panel flaps, with the underlying flap being folded over upon itself to provide a three-ply layer in the handle area. The transverse extent of the three-ply layer was from approximately the middle of one handle opening to the middle of the other handle opening. In both cases the carriers were formed from 0.027 inch paperboard stock with similar adhesive. The carriers were tested to failure in a centrifugal carton testing machine of the type described in U.S. Pat. No. 4,553,438. In such a machine the amount of force required to rupture or tear the handle of a fully loaded carton is determined.

Figure 5:
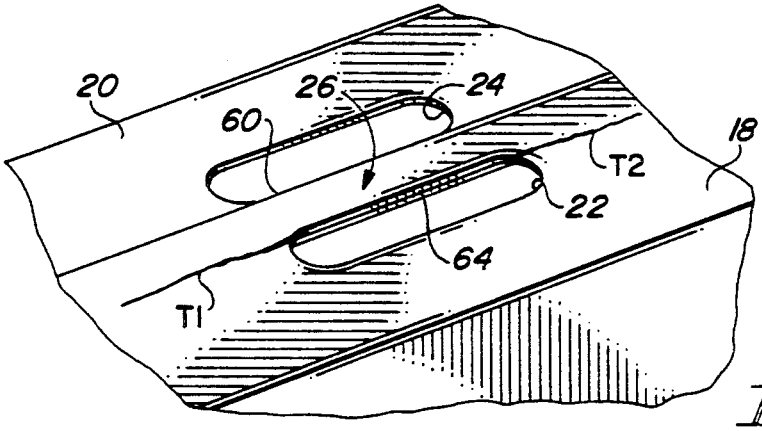
FIG. 5 is an enlarged partial pictorial view of the carrier handle of the present invention as it would appear after a typical failure.

Twenty cartons of each design were tested to failure. The average force required to rupture the handle of the conventional carton was 82.8 pounds. The average force required to take the handle of the present design to failure was 121.8 pounds. The mode of failure of the conventional carton was generally across the handle strap at or near adjacent ends of the handle openings. The mode of failure of the carton of the invention was generally as illustrated in FIG. 5, wherein one of the top panel flaps failed along the tear lines T1 and T2 extending from both ends of the handle opening 22 to the end panels, parallel to the length of the carton substantially along one of the folded edges 60 or 64. One significant feature of the invention which is brought out by the test results is that it takes a great deal more force or stress to cause the handle of the present invention to fail than it does to cause the conventional handle to fail. A much stronger package can be provided with the present invention or, if preferred, a package of similar strength to that of the conventional carton can be provided by employing lower caliper stock, thereby reducing the cost of the carton. Another significant point is that if failure does occur, it does so along one of the folded edges in the reinforced center portion of the top panel. This leaves the handle intact and allows the consumer to continue carrying the full carton without danger of the contents falling out. Failure of the conventional carton across the handle strap results in failure of the handle itself, causing the carrier to fall and in all likelihood at least some of the cans to spill out.

It is believed that the great strength of the handle of the invention can be attributed in part to the fact that the folded edges of the handle strap technically comprise a surface, in the sense that this term is used in fracture mechanics, rather than an edge because the fold actually is comprised of an unbroken surface. The significance of this is that in accordance with fracture mechanics tear initiation is more difficult from a surface than from an edge, which is why tearing of the top panel at failure begins at the arcuate end portion of the handle opening, which is a true edge, not a folded edge. The fact that the handle portion is comprised of four layers of paperboard also adds to the strength of the handle.

Figure 6:
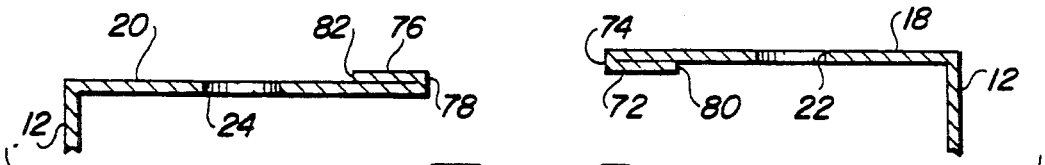
FIG. 6 is an enlarged partial transverse sectional view similar to that of FIG. 3, but showing another embodiment of the invention.
Figure 7:
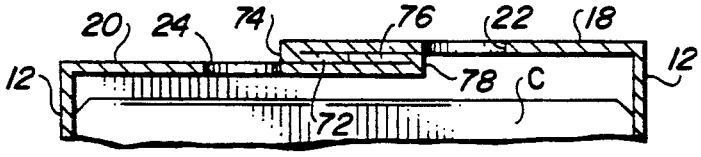
FIG. 7 is an enlarged partial transverse sectional view of the carton handle area of the carrier of FIG. 6.

Another embodiment of the invention which is also capable of providing a handle strap with folded edges is illustrated in FIGS. 6 and 7. In this design, the outer top panel flap 18 is provided with reinforcement flap 72 which is folded under to form a fold 74. Instead of extending all the way to the inner edge of the handle opening 22, as in the first embodiment, the end 80 of the reinforcement flap 72 extends only half the distance from the fold 74 to the inner edge of the opening. The inner top panel flap 20 is also provided with a reinforcement flap 76 which is folded onto the upper surface of the inner top panel flap to form a fold 78. As in the case of the reinforcement flap 72, the end 82 of the reinforcement flap 76 extends only half the distance from the fold 78 to the inner edge of the handle opening 24. When the overlapping portions of the outer and inner top panel flaps are moved into place and adhered together, the reinforcement flap 72 fits in the space between the end 82 of reinforcement flap 76 and the inner edge of the handle opening 24. Similarly, the reinforcement flap 76 fits into the space between the end 80 of reinforcement flap 72 and the inner edge of the handle opening 22.

As shown in FIG. 7, although this arrangement produces a three-ply strap portion instead of the four-ply portion described above, it does nonetheless provide a fold at each edge of the strap as in the four-ply design. The tear resistance and handle strength of this arrangement is thus greatly improved as in the first embodiment. Although this embodiment of the invention has been described as having reinforcement flaps that extend halfway from the fold to the inner edge of the associated handle opening, the structure could obviously be formed from reinforcement flaps that terminate at other points between the fold and the handle opening. In all cases, however, the combined widths of the reinforcement flaps should equal the width of the handle strap, so that if one of the reinforcement flaps is less than half the width of the strap, the other reinforcement flap would be correspondingly wider. Such an arrangement is not preferred, however, due to the increased difficulty in folding a reinforcing flap that is less than half the width of the strap portion.

It can be appreciated from FIG. 2 that when the reinforcement flaps are folded over upon the adjacent top panel flap, subsequent folding of the upper end panel flaps to a position at right angles to the associated top panel flap will present a problem because of the extra material involved. This is illustrated in connection with the first embodiment of the invention in FIG. 6, which shows the double layer of material that must be folded when folding the upper end panel flaps into position prior to the end panel flaps 30 and 32 being folded over. This can cause the plies to buckle or distort along the fold line 60 in the area of the fold line 54, creating stresses which could cause the adhesive bonds holding the reinforcement flaps in place to weaken or to be overcome.

Figure 8:
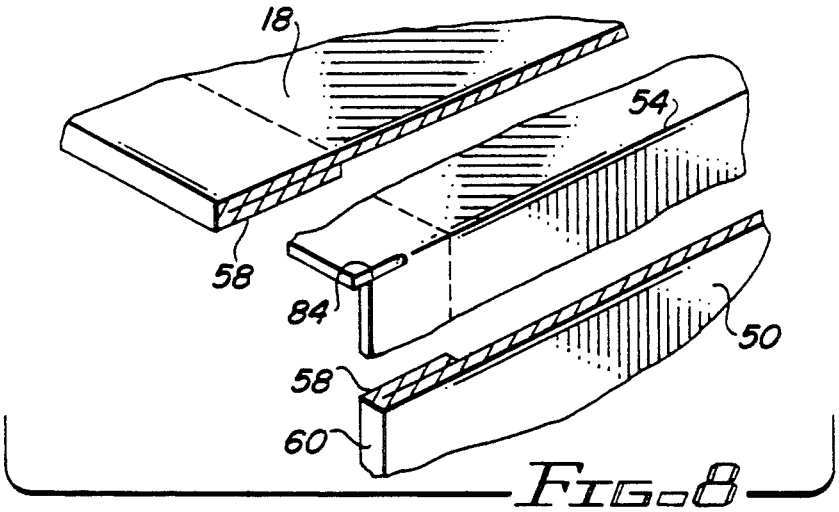
FIG. 8 is an enlarged partial pictorial view of a folded top end panel flap showing the reinforced edge portion.
Figure 9:
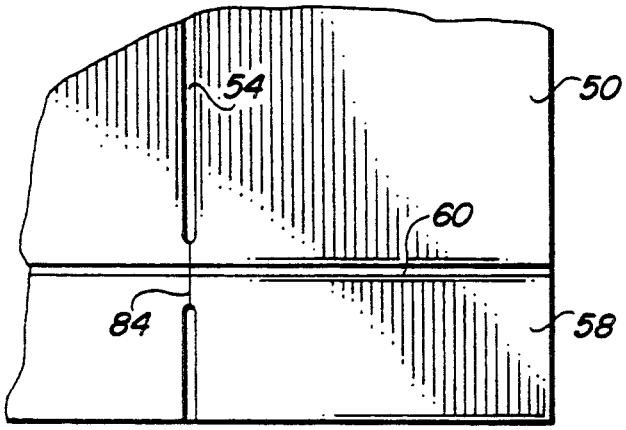
FIG. 9 is an enlarged partial plan view of the portion of the carrier blank enclosed within the circle 9 in FIG. 2, which corresponds to the folded structure of FIG. 8.

To overcome this problem the arrangement shown in FIG. 9 is provided, wherein the fold line 54 is weakened in the area of its intersection with the fold line 60. In this case the fold line 54 is a score line which is weakened by being interrupted in the area of the fold line 60 by a slit 84. Thus the slit 84 intersects the fold line 60, also shown as a score line, and extends along the fold line 54 for a sufficient additional distance so that the slit lies in both the flap 50 and the flap 58 after the flap 50 has been folded down from the top panel flap 18. This is illustrated in FIG. 8, wherein the slit 84 is shown in the flap 50, it being understood that the slit in the flap 58 would look substantially the same. This arrangement relieves the stresses along the fold line 60 at the critical folded area to the point where the reinforcing flaps will readily remain in their folded adhered positions.

Figure 10:
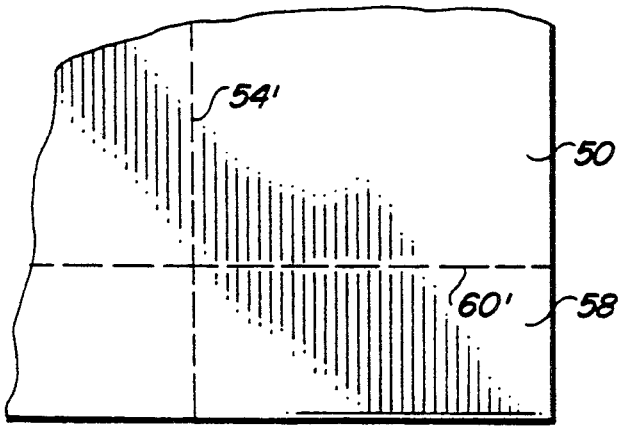
FIG. 10 is an enlarged partial plan view similar to that of FIG. 9, but showing a modified arrangement.

Although preferred, it is not essential that the fold lines involved be formed as score lines. As shown in FIG. 10, for example, the fold lines 54' and 60' are formed as skip-cut lines wherein spaced slits define the fold lines. In such an arrangement a cut or slit in the fold line 54' would be located so as to intersect the fold line 60' in the manner described above. Preferably, a cut or slit in the fold line 60' would also intersect the fold line 54' to further ease the folding of the flap 50. Obviously, it is not necessary that both the intersecting fold lines of the blank be of the same type. One could be formed as a score line and the other as a skip-cut line, if desired, as long as the intersecting slit relationship described is present. While this aspect of the invention has been discussed in connection with the four-ply design, it will be understood that it applies to the three-ply design as well.

The invention not only increases the strength of the handle, but also provides for failure of the carton, if it should occur, to be along the length of the top panel rather than in the usual manner across the handle strap. This enables the carton and contents to remain an integral package even if failure of the carton occurs. The invention also allows paperboard stock of less caliper, and therefore of less cost, to be used if desired.

It should now be appreciated that the invention need not necessarily be limited to all the specific details described in connection with the preferred embodiments, but that changes to certain features which do not alter the overall basic function and concept of the invention may be made without departing from the spirit and scope of the invention defined in the appended claims.

We claim:

1. An article carrier, comprising:

two side panels, each having a top edge connected to a top panel, a bottom edge connected to a bottom panel and end edges connected to opposite end panels;

the top panel being formed from an outer top panel flap foldably connected to one of the side panels along the top edge thereof and an inner top panel flap foldably connected to the other side panel along the top edge thereof, the outer top panel flap having a portion overlapping a portion of the inner top panel flap to form an overlapped area, the outer top panel flap being adhered to the inner top panel flap in the overlapped area;

each top panel flap containing a handle opening having an inner edge, an outer edge and side edges therebetween, the handle openings being on opposite sides of the overlapped area; and the portion of the outer top panel flap in the overlapped area being folded over upon itself along a first fold to form a layer of double thickness adjacent the handle opening in the inner top panel and the portion of the inner top panel flap in the overlapped area being folded over upon itself along a second fold to form a layer of double thickness adjacent the handle opening in the outer top panel flap, whereby the first and second folds are adjacent the inner edges of the handle openings, said first and second folds each being greater in length than the distance between the side edges of at least one of said handle openings.

2. The article carrier of claim 1, wherein the first and second folds are substantially aligned with the inner edges of the handle openings.

3. The article carrier of claim 2, wherein the inner edges of the handle openings extend substantially parallel to the top edges of the side panels.

4. The article carrier of claim 1, wherein each end panel is comprised of flaps connected to the top, bottom and side panels, the end panel flap connected to the top panel comprising extensions of the inner and outer top panel flaps, including a multi-ply portion corresponding to the overlapped portion of the top panel.

5. The article carrier of claim 4, wherein the end panel flap extension of the outer top panel flap is connected to the outer top panel flap along a third fold which intersects said first fold, and the end panel flap extension of the inner top panel flap is connected to the inner top panel flap along a fourth fold which intersects said second fold, said third and fourth folds being weakened at the point of intersection with said first and second folds, respectively, and in the immediate areas on either side of said points of intersection.

6. An article carrier, comprising:

two side panels, each having a top edge connected to a top panel, a bottom edge connected to a bottom panel and end edges connected to opposite end panels;

the top panel being formed from an outer top panel flap foldably connected to one of the side panels along the top edge thereof and an inner top panel flap foldably connected to the other side panel along the top edge thereof, the outer top panel flap having a portion overlapping a portion of the inner top panel flap to form an overlapped area, the outer top panel flap being adhered to the inner top panel flap in the overlapped area;

each top panel flap containing a handle opening having an inner and an outer edge, the handle openings being on opposite sides of the overlapped area; and the portion of the outer top panel flap in the overlapped area being folded over upon itself along a first fold to form a layer of double thickness adjacent the handle opening in the inner top panel and the portion of the inner top panel flap in the overlapped area being folded over upon itself along a second fold to form a layer of double thickness adjacent the handle opening in the outer top panel flap, whereby the first and second folds are adjacent the inner edges of the handle openings;

the folded-over portion of the outer top panel flap being adhered to the underside of the outer top panel flap, and the folded-over portion of the inner top panel flap being adhered to the underside of the inner top panel flap.

7. The article carrier of claim 6, wherein the overlapped portions of the top panel flaps form a four-ply handle strap portion between the handle openings.

8. The article carrier of claim 7, wherein the overlapped portions of the top panel flaps have a width substantially equal to the distance between the inner edges of the handle openings.

9. An article carrier, comprising:

two side panels, each having a top edge connected to a top panel, a bottom edge connected to a bottom panel and end edges connected to opposite end panels;

the top panel being formed from an outer top panel flap foldably connected to one of the side panels along the top edge thereof and an inner top panel flap foldably connected to the other side panel along the top edge thereof, the outer top panel flap having a portion overlapping a portion of the inner top panel flap to form an overlapped area, the outer top panel flap being adhered to the inner top panel flap in the overlapped area;

each top panel flap containing a handle opening having an inner and an outer edge, the handle openings being on opposite sides of the overlapped area; and the portion of the outer top panel flap in the overlapped area being folded over upon itself along a first fold to form a layer of double thickness adjacent the handle opening in the inner top panel and the portion of the inner top panel flap in the overlapped area being folded over upon itself along a second fold to form a layer of double thickness adjacent the handle opening in the outer top panel flap, whereby the first and second folds are adjacent the inner edges of the handle openings;

the folded-over portion of the outer top panel flap being adhered to the underside of the outer top panel flap, and the folded-over portion of the inner top panel flap being adhered to the upper side of the inner top panel flap.

10. The article carrier of claim 9, wherein the overlapped portion of each of the top panel flaps has a width less than the distance between the inner edges of the handle openings, but wherein the combined widths of the overlapped portions of the top panel flaps substantially equals the distance between the inner edges of the handle openings.

11. The article carrier of claim 10, wherein the overlapped portions of the top panel flaps form a three-ply handle strap portion between the handle openings.

* * * * *